US006868814B2

(12) United States Patent
Baur et al.

(10) Patent No.: US 6,868,814 B2
(45) Date of Patent: Mar. 22, 2005

(54) METHOD FOR MANUFACTURING A MULTI-PART VALVE FOR INTERNAL COMBUSTION ENGINES

(75) Inventors: Hartmut Baur, Ertingen (DE); Peter Busse, Aachen (DE); Daniel Bala Wortberg, Ulm (DE)

(73) Assignee: DaimlerChrysler AG, Stuttgart (DE)

( * ) Notice: Subject to any disclaimer, the term of this patent is extended or adjusted under 35 U.S.C. 154(b) by 33 days.

(21) Appl. No.: 10/376,652

(22) Filed: Feb. 27, 2003

(65) Prior Publication Data

US 2003/0209218 A1 Nov. 13, 2003

(30) Foreign Application Priority Data

Mar. 2, 2002 (DE) ..... 102 09 346

(51) Int. Cl.[7] ..... F02N 3/00; B23P 17/00
(52) U.S. Cl. ..... 123/188.3; 29/888.453
(58) Field of Search ..... 123/188.3, 188.2; 29/888.453

(56) References Cited

U.S. PATENT DOCUMENTS 4,522,374 A 6/1985 Neff
4,834,036 A 5/1989 Nishiyama et al. ..... 123/188
6,161,285 A * 12/2000 Eberhardt et al. ..... 29/888.451

FOREIGN PATENT DOCUMENTS

| | | |
|---|---|---|
| DE | 3509453 | 9/1986 |
| DE | 692 18 082 | 6/1997 |
| DE | 100 38 332 | 2/2002 |
| EP | 05 32 434 | 3/1997 |
| WO | 98 32 557 | 7/1998 |

OTHER PUBLICATIONS

Lutz "Druckguss—ein wirtschaftliches Fertigungsverfahren," in TZ fuer prakt. Metallarbeit, vol. 10, 1961, pp. 576 (translation enclosed).

STETS "Werkstoffkundliche Grundiagen des Verbundglessens von Gusseisen mit Stahl." in Giesserei 86, Aug. 19, 1999, pp. 55 (translation enclosed).

* cited by examiner

*Primary Examiner*—Noah P. Kamen
(74) *Attorney, Agent, or Firm*—Davidson, Davidson & Kappel, LLC

(57) ABSTRACT

For making an interconnection between a valve head and stem, the interconnection between these parts is made by pouring a cast alloy around the stem end. A connection and a valve are also provided.

6 Claims, 1 Drawing Sheet

METHOD FOR MANUFACTURING A MULTI-PART VALVE FOR INTERNAL COMBUSTION ENGINES

Priority to German Patent Application No. 102 09346.6-24, filed Mar. 2, 2002 and hereby incorporated by reference herein, is claimed.

BACKGROUND INFORMATION

The present invention relates to a manufacturing method for a connection between a valve head and a valve stem of a multi-part valve, to a connection made using the method, and to an automotive engine valve made using the method.

Valves used in mass production are mostly based on high-temperature resistant steel, at least in the valve head area. The valve stem is made of less highly alloyed steel and is connected to the valve head by friction welding. In the valve seat area, valve heads are either plasma-coated with a wear-resistant material or hardened. From racing, valves are known that are made of titanium and TiAl. Currently, it is being considered to manufacture and use powder-metallurgically produced or cast solid valves of TiAl.

However, cast solid valves can be manufactured using by centrifugal casting or using a kind of a pressure diecasting or injection method. In order to avoid pores in the stem area which is difficult to feed, appropriate preheating must be provided in the permanent molds used. For this purpose, correspondingly expensive permanent mold materials are needed, such as niobium or tantalum. Moreover, the preheating operations increase cycle the times during production. Heretofore, however, it has not yet been possible to avoid residual porosity in the stem, even under optimum temperature control.

In the case of multi-part valves, different requirements are placed on the head and the stem. In particular, valve heads must be highly resistant to temperature and wear, whereas the valve stem must have a high strength in conjunction with a high resistance to abrasion at the stem end. The most convenient material is chosen in each case according to the requirements placed on the valve parts. When using valve heads, for example, of TiAl, the stem can be chosen to be made of suitable steel.

Conventional approaches to produce multi-part valves are limited to manufacturing the valve head and the stem separately from each other and to interconnect them in a subsequent process step.

U.S. Pat. No. 4,834,036 describes a method for making an interconnection between a valve head and a valve stem which is hollow inside. During manufacture, the stem end which is inserted in the head is expanded and connected thereto in a positive-locking manner under the influence of heat with the aid of a pressure medium which is pressed into the hollow valve stem.

Apart from single-part models, multi-part valves have the disadvantage of having to ensure a suitable connection of the individual parts.

BRIEF SUMMARY OF THE INVENTION

An object of the present invention is to manufacture and connect the parts of multi-piece valves in a simple and reliable manner.

The present invention provides for a method for making an interconnection between a valve head (1) and a valve stem (2) of a multi-part valve, in particular for motor vehicle engines, wherein the interconnection between these parts is made by pouring a casting intermetallic compound of titanium aluminide around a valve stem end made of steel.

Using this method, the present invention also provides a connection of a valve stem (1) to a valve head (2) of a multi-part valve, wherein the connection is accomplished by friction fit or positive fit or integral connection or by a combination, as well as an automotive engine valve, which is composed of a valve stem (1) and a valve head (2), wherein the valve stem (1) is composed of a steel alloy and the valve head (2) is composed of an intermetallic compound of the system Ti/Al.

The present invention thus describes a method for manufacturing a multi-part valve for motor vehicles on the basis of an in-situ connection of the valve head and stem using a casting process.

In the method according to the present invention for making an interconnection between a valve head and the stem, the interconnection between these parts is made by pouring a casting alloy around one stem end.

The connection of the head and the stem is accomplished in that, during the manufacture of the valve using a casting process, the stem is already integrated in a permanent mold, and thus directly cast-in.

It is important for a proper connection that no hot cracks occur during casting. These hot cracks result from tensions due to the volume contraction during solidification in the solid-liquid interval which exceed the strength of the solidifying material and which cannot heal due to lack of secondary feeding.

Therefore, the present invention proposes two measures to prevent these hot cracks. According to the present invention, first of all, the temperature control of the permanent mold and of the valve stem located therein is implemented such that a controlled solidification in a direction opposite to the mold filling direction is carried out, preferably including appropriate secondary feeding.

According to the present invention, moreover, a secondary feeding of the cast alloy is carried out at high filling pressure during casting to heal formed cracks.

The casting pressure required to fill the mold is reached, for example, due to the centrifugal force occurring during centrifugal casting.

The use of the permanent mold centrifugal casting process appears to be suitable for this purpose.

Technically, the process provides the particular advantage of achieving a very rigid connection of the valve head and stem due to the press-fit connection. Moreover, it is also possible to achieve optimum positive fit and, possibly even an integral connection.

The manufacturing process advantageously stands out compared to other joining techniques because of its economic efficiency, since the manufacture of multi-part valves is carried out in one step. This eliminates the need for subsequent processing steps to connect these two components.

In the method according to the present invention, the connection between the valve head and stem is accomplished by pouring the cast alloy around one stem end.

The connection of a valve head to the valve stem is primarily a friction fit due to the frictional forces between the head and the stem resulting from the press-fit connection.

The fundamental basis of the press-fit connection is provided by the shrinking of the cast alloy on the stem. Upon solidification, the cast alloy has a considerably higher temperature than the stem. The volume contraction associated with the cooling of the cast alloy is therefore greater, independently of whether the stem has a smaller or larger coefficient of thermal expansion than the cast alloy. The valve head made of the cast alloy shrinks on the stem during cooling.

A further subject matter of the present invention is the configuration of the valve stem end in order to accomplish a positive fit. For example, the stem end can be designed with a circumferential groove so as to produce an undercut around which flows the cast alloy, resulting in a kind of an interlocking of the head and the stem. Moreover, the stem end should, if possible, be designed such that the stem and the head are prevented from rotating relative to each other during later operation. This can be achieved, for example, by a groove or notch which extends perpendicular to the stem axis on the stem end, the groove or notch breaking the rotational symmetry of the stem and being infiltrated during the filling of the mold. Furrows or notches parallel to the stem axis are conceivable as well.

The metallurgical joint or integral connection, that is, the fusion or joining by fusion of the head and the stem material, can be achieved by a suitable material combination and selective temperature control of the stem and of the permanent mold. In this context, moreover, any form of groove or notch increases the contact area between the stem and the casting material, and represents an additional bonding surface in the combination with a desired metallurgical joint.

However, if the intention is to deliberately avoid such a metallurgical joint, then a diffusion barrier can be applied between the casting material and the stem, at least at the stem end which is cast-in. Such a diffusion barrier can be composed of a molybdenum film or of a molybdenum layer which is applied to the stem and prevents joining by fusion during the mold-filling period.

The valve stem is preferably composed of steel, of titanium or titanium alloys, or of an intermetallic alloy of the systems titanium—aluminum, in particular based on gamma-TiAl; iron—aluminum, for example, based on FeAl; and of the system nickel—aluminum, for example, based on NiAl.

Preferably, a cavity is formed inside the valve stem, the cavity being either empty or filled with sodium.

The valve head and stem can be made of the same material. However, it is preferred to use a material for the head that has a lower density than the stem material. The materials or intermetallic alloys proposed are those of the systems titanium—aluminum, in particular based on gamma-TiAl; iron—aluminum, for example, based on FeAl; and of the system nickel—aluminum, for example, based on NiAl. According to the present invention, it is also possible to use conventionally employed steels using the casting method.

BRIEF DESCRIPTION OF THE DRAWINGS

In the following, the present invention will be described and illustrated in greater detail with reference to several selected exemplary embodiments in connection with the accompanying drawings, in which.

DETAILED DESCRIPTION

Figure 1:
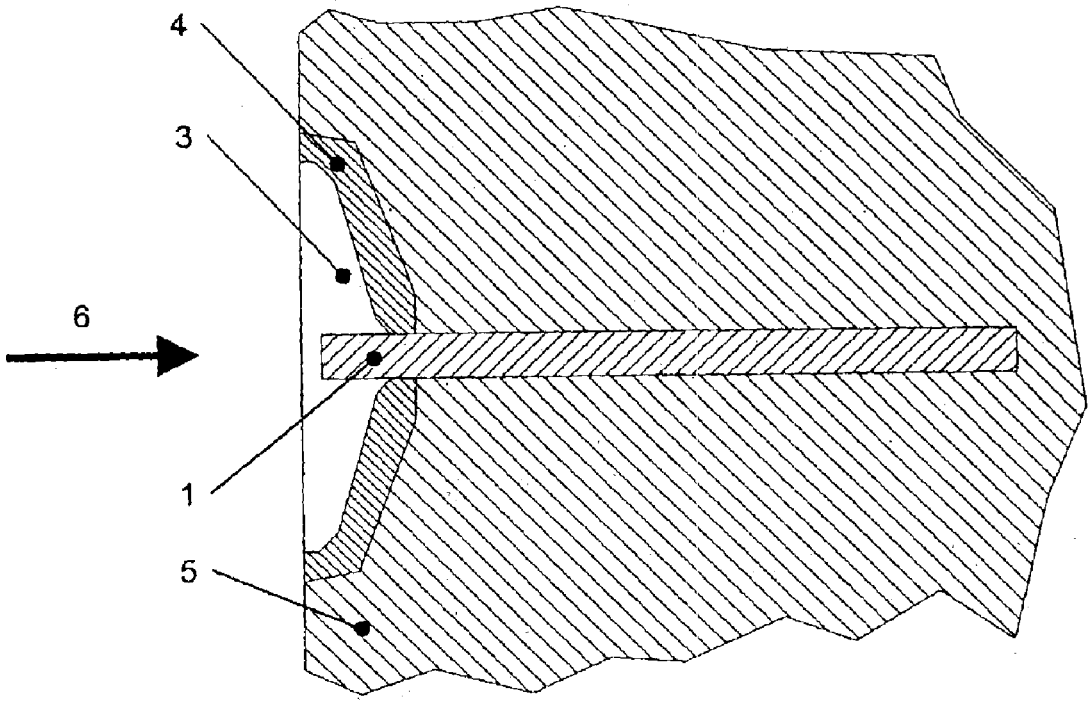
FIG. 1 is a cross-section of a permanent mold having a mold insert, including an integrated valve stem.

Permanent mold 5 with integrated valve stem 1, which is shown in FIG. 1, is used to manufacture the valves. According to the present invention, it is proposed for permanent mold 5 to be manufactured preferably from a high-temperature resistant steel, and to insert a mold insert 4 into the permanent mold, the mold insert being made of a high-temperature resistant steel or of niobium or tantalum and forming the mold cavity for valve head 2. The permanent mold is provided with a bore whose end is connected to the mold cavity. Valve stem 1 is inserted into this bore. In this context, the length of the bore is selected such that one end of the stem extends from the bore into the mold cavity for valve head 2.

Figure 2:
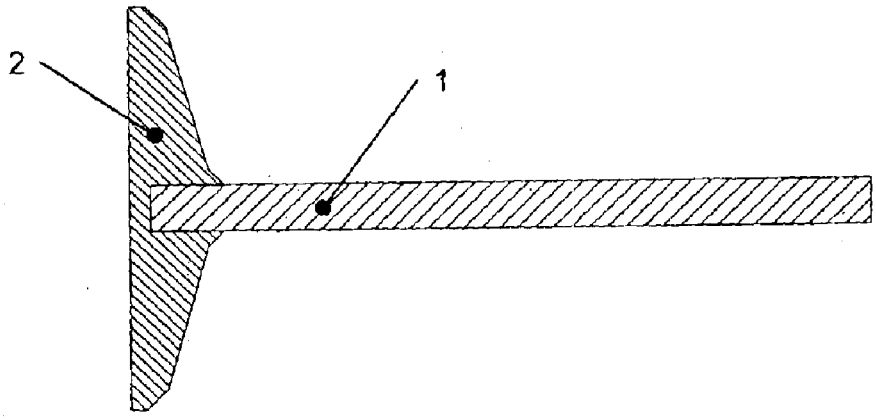
FIG. 2 depicts a section through a valve composed of a stem and a head.

The connection between valve head 2 and valve stem 1 is accomplished by pouring the casting alloy around valve stem 1 (FIG. 2).

The temperature control of permanent mold 5 and of stem 1 located therein is to be implemented such that a controlled solidification in a direction opposite to mold filling direction 6 is carried out, including appropriate secondary feeding.

FIG. 2 shows the completed valve composed of valve stem 1 and of valve head 2, which surrounds the stem. The connection between the stem and the head is primarily the press-fit connection shown. In addition, it is possible to accomplish a positive fit. Depending on the selected alloy, in particular in the case of identical or similar stem and head materials, the connection can additionally be of a chemical or metallurgical nature, that is, represent an integral connection.

Figure 3:
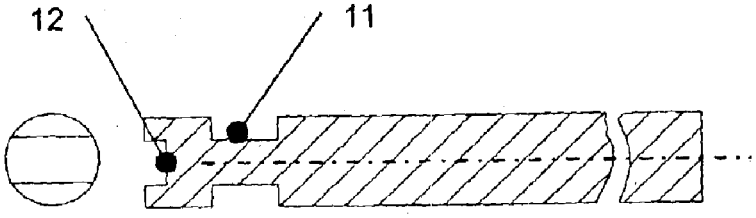
FIG. 3 shows the configuration of the stem end which is surrounded by the valve head.

In the view of FIG. 3 is shown, in particular, the configuration of the stem end. For example, the stem end can be designed with a circumferential groove 11 so as to produce an undercut around which flows the casting alloy, resulting in a kind of an interlocking of the head and the stem, thus providing a positive fit. Moreover, the stem end should, if possible, be designed such that the stem and the head are prevented from rotating relative to each other during later operation. This can be achieved, for example, by groove or notch 12 shown in the drawing which extends perpendicular to the stem axis on the stem end, the groove or notch breaking the rotational symmetry of the stem and being infiltrated during the filling of the mold. Furrows or notches parallel to the stem axis are conceivable as well.

The filling of the mold is preferably carried out using a permanent mold casting method which allows pressure-assisted mold filling and solidification. Centrifugal casting appears to be particularly suitable. However, it is also conceivable to use pressure casting processes, such as classical pressure diecasting or squeeze casting. Furthermore, it is conceivable to use semi-solid metal ("SSM") casting (or semi-solid metal forging). This term, which is used in scientific language, is understood to mean a method in which, unlike conventional pressure casting methods, metal, in this case the alloy for the valve head, is processed in the semi-solid state instead of liquid metal. The use of SSM casting has various advantages in the context of the idea according to the present invention. If an undesired reaction between the stem material and the valve material is expected, this reaction is considerably reduced by using a semi-solid melt which has a lower thermal energy compared to liquid material. In addition, the use of semi-solid material reduces the thermal shrinkage in such a manner that the valve head has an initial shape which nearly corresponds to the final dimensions (so-called "near-net-shape quality") and the risk of cracking is reduced.

LIST OF REFERENCE NUMERALS

1 valve stem
2 valve head

3 valve head cavity
4 mold insert
5 permanent mold
6 mold filling direction
11 groove
12 transverse groove/notch

What is claimed is:

1. A method for making a connection for a valve head to a valve stem of a multi-part valve comprising the step of:

pouring a casting intermetallic compound of titanium aluminide around an end of the valve stem, the end being made of steel.

2. The method as recited in claim 1 wherein the titanium aluminide is mainly composed of gamma-TiAl.

3. The method as recited in claim 1 further comprising assisting a secondary feeding of the casting intermetallic compound with a high filling pressure in order to prevent cracking during casting.

4. The method as recited in claim 1 wherein, in order to prevent cracking, the solidification of the casting intermetallic compound is carried out in a direction opposite to a mold filling direction.

5. The method as recited in claim 4 wherein the pouring includes a secondary feeding.

6. The method as recited in claim 1 wherein the valve is for motor vehicle engines.

* * * * *